US007415743B2

(12) United States Patent
Rubio

(10) Patent No.: US 7,415,743 B2
(45) Date of Patent: Aug. 26, 2008

(54) INCLINED BED

(76) Inventor: Horacio C. Rubio, P.O. Box 534131, Harlingen, TX (US) 78553

( * ) Notice: Subject to any disclaimer, the term of this patent is extended or adjusted under 35 U.S.C. 154(b) by 369 days.

(21) Appl. No.: 11/216,563

(22) Filed: Sep. 1, 2005

(65) Prior Publication Data

US 2006/0070185 A1 Apr. 6, 2006

Related U.S. Application Data

(60) Provisional application No. 60/615,980, filed on Oct. 5, 2004.

(51) Int. Cl.
*A47C 27/15* (2006.01)
*A47C 27/10* (2006.01)
*A47D 7/01* (2006.01)

(52) U.S. Cl. ..... 5/722; 5/632; 5/655; 5/732; 5/657; 128/845

(58) Field of Classification Search ..... 5/722, 5/632, 655, 732, 657, 710, 690; 128/845
See application file for complete search history.

(56) References Cited

U.S. PATENT DOCUMENTS

| | | | | |
|---|---|---|---|---|
| 2,229,536 | A | 1/1941 | Wilkich | |
| 2,281,629 | A | 5/1942 | Snow | |
| 2,767,410 | A | 10/1956 | Benson | |
| 3,100,305 | A * | 8/1963 | Kaye | 5/732 |
| 3,608,106 | A | 9/1971 | Parramon | |
| 4,171,549 | A * | 10/1979 | Morrell et al. | 5/632 |
| 4,473,913 | A * | 10/1984 | Ylvisaker | 5/657 |
| D282,802 | S | 3/1986 | Righini | |
| D282,803 | S | 3/1986 | Righini | |
| 4,639,960 | A * | 2/1987 | Quillen et al. | 5/710 |
| 4,853,993 | A * | 8/1989 | Walpin et al. | 5/634 |
| 5,448,790 | A * | 9/1995 | Saro et al. | 5/657 |
| 5,800,368 | A | 9/1998 | Klingemann et al. | |
| 5,815,862 | A * | 10/1998 | Rygiel | 5/632 |
| 5,836,653 | A | 11/1998 | Albecker | |
| 6,085,373 | A | 7/2000 | Montana | |
| 6,334,442 | B1 * | 1/2002 | Altamura | 128/845 |
| 6,848,137 | B1 * | 2/2005 | Barnes | 5/710 |
| 6,925,670 | B2 * | 8/2005 | Torrez | 5/731 |
| 2002/0042954 | A1 | 4/2002 | Straub | |

* cited by examiner

*Primary Examiner*—Alexander Grosz
(74) *Attorney, Agent, or Firm*—G. Turner Moller

(57) ABSTRACT

A child's bed is made of upper and lower wedge shaped sections providing a generally V-shaped bed. The upper and lower sections are unconnected to each other and are made of one or more wedge shaped members that are unconnected to each other. A fitted sheet holds the components together as a unit. An egg crate foam layer may be affixed to the lower section and draped over the upper section to improve stability. The incline of the upper and lower sections is adjustable by adding or removing one or more of the wedge shaped members. The low point of the V-shaped bed is disposed adjacent the knee of the sleeper so the person can sleep in a fetal position with the feet and lower leg preventing the sleeper from sliding down the incline of the upper section.

14 Claims, 1 Drawing Sheet

INCLINED BED

This application is based on provisional application Ser. No. 60/615,980, filed Oct. 5, 2004.

This invention relates to a foam or inflatable based bed and more particularly to an inclined bed.

BACKGROUND OF THE INVENTION

It is known in the prior art to provide specially designed beds for children, particularly children who have a medical condition that is aggravated by normal sleeping positions. Typically these beds position the child in an inclined position. Sometimes the bed is planar with the feet at the lowest point of the bed and sometimes the bed is V-shaped with the buttocks at a low point of the bed.

Wedge shaped pillows have been proposed in the past to elevate the head of a child to alleviate problems associated with asthma, acid reflux, chronic sinusitis and the like. These pillows have largely been ineffective because children tend to slip down the pillow during sleep and end up with their head at the foot of the pillow, meaning the wedge shape has no effect.

There is no bed configuration that is optimum for all children because different conditions and preferences dictate different bed configurations. Because most prior art beds are of fixed design, any particular configuration is suitable for only a small proportion of children with sleeping problems.

Disclosures relevant to the disclosure of this invention are found in U.S. Pat. Nos. 2,229,536; 2,281,629; 2,767,410; 3,608,106; 4,853,993; 5,448,790; 5,800,368; 5,836,653; 6,085,373; 6,334,442; D282,802; D282,803 and printed patent application 2002/0042954.

SUMMARY OF THE INVENTION

In this invention, a bed may be sized for an adult or an adolescent, but the most common use of this invention is thought to be for a child's bed. A child's bed of this invention is made of a series of separate wedge shaped components that are held in a sleeping configuration by a sheet or cover overlying the components. The wedge shaped components are arranged with the small or thin end of the components in juxtaposed relation to provide a generally V-shaped bed. An upper end of the bed is provided with integral side rails to prevent the child from rolling off the bed. The inclination or slope of the upper and/or lower ends of the bed are adjustable by inserting removable wedge shaped components between the sleeping surface and an underlying support. It will accordingly be seen that the incline of the upper and lower sections may be readily adjusted to accommodate differences in the requirements or preferences of the sleeper.

An important feature of this invention is that the low spot intermediate the ends of the V-shaped bed does not typically correspond to the buttocks of the sleeper. Instead, this low spot is often adjacent the knees of the sleeper so the sleeper's feet abut and push against the lower end of the bed. The purpose of an inclined bed is to elevate the child's head and this configuration avoids the child slipping down the incline during sleep but also allows the child considerable freedom of movement, as contrasted to being relatively fixed as in the situation where the low spot of a V-shaped pillow is at the buttocks of the child. In particular, the most common sleeping position of a child is in the fetal position, i.e. on one side with the knees tucked up toward the torso. The bed of this invention allows such a position while minimizing the tendency of the child to slip down the incline.

It is an object of this invention to provide an improved bed.

It is an object of this invention to provide an inclined child's bed made of foam or inflatable materials which is capable of having the incline adjusted in a simple, expeditious manner.

A further object of this invention is to provide an inclined child's bed which is made of components that are not connected together and which are thereby easily adjustable.

Another object of this invention is to provide an inclined child's bed which allows the child to sleep in a natural fetal position.

These and other objects and advantages of this invention will become more apparent as this description proceeds, reference being made to the accompanying drawings and appended claims.

DETAILED DESCRIPTION

Figures 1, 2, 3, 4, 5, 6, 7, 8, 9:
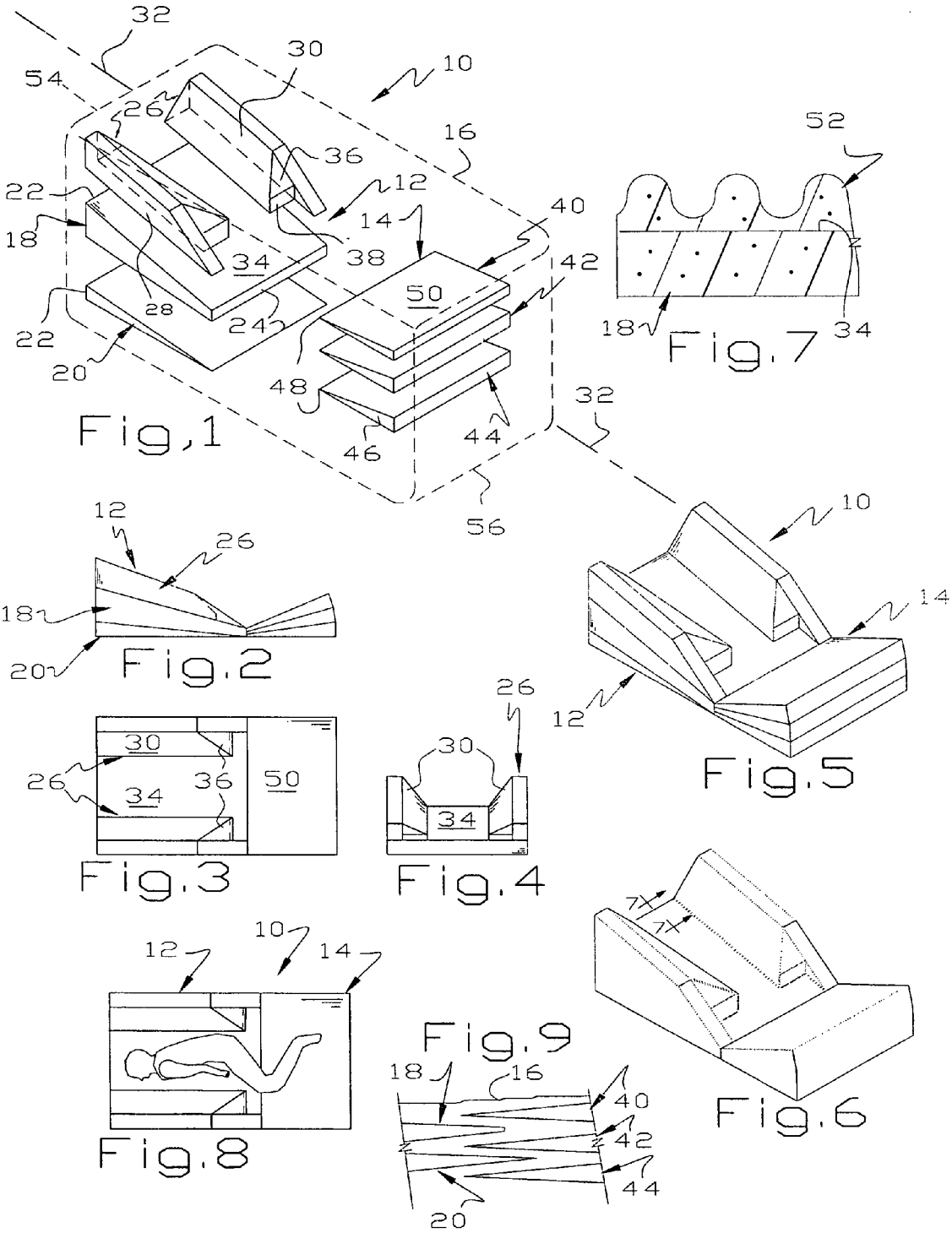
FIG. 1 is an exploded isometric view of structural foam components making up a child's bed of this invention.
FIG. 2 is a side view of the assembled structural components of FIG. 1.
FIG. 3 is a top view of the structural components of FIGS. 1 and 2.
FIG. 4 is an end view of the structural components of FIGS. 1-3.
FIG. 5 is an isometric view of the structural components of FIGS. 1-4, illustrated in an operative configuration.
FIG. 6 is a view similar to FIG. 5 showing a foam covering over the structural components.
FIG. 7 is an enlarged cross-sectional view of FIG. 6, taken substantially along line 7-7 thereof as viewed in the direction indicated by the arrows.
FIG. 8 is a top view of the bed of this invention showing a child in a fetal position.
FIG. 9 is a broken partial side view of the bed of this invention illustrating the wedges in an interdigitated position thereby shortening the overall length of the bed, the wedges being illustrated as vertically spaced for clarity of illustration.

Referring to FIGS. 1-8, a bed 10 comprises an upper end 12, a lower end 14 and a cover 16 constraining the upper and lower ends 12, 14 from moving relative to each other. The upper and lower ends 12, 14 are preferably independent and unconnected, except for the action of the cover 16. As mentioned previously, the bed may be sized for an adult or adolescent, but it is more commonly sized for a child. As will become apparent, the foam or inflatable structure of this invention may be placed inside a crib or on a toddler's bed and thereby provide a sleeping surface for a child.

The upper end 12 comprises one or more independent wedge shaped members 18, 20 having a thick end 22 corresponding to the head end of the bed 10 and a thin end 24 juxtaposed to the lower bed end 14. The uppermost of the members 18 provides a pair of mirror image side rails 26, affixed to the member 18, including a vertical outer wall 28 aligned with outer edge of the member 18 and an inclined inner wall 30 facing a centerline 32 of the bed 10. The upper member 12 and its side rails 26 accordingly provide a sleeping surface which is upwardly concave as viewed in FIG. 4. This prevents a child from rolling off the bed 10 and/or constrains movement of the child during sleep. The forward end of the side rails 26 makes a convenient transition to the top surface 34 of the member 18 in any suitable fashion, as by the provision of angled surfaces 36, 38. It will accordingly be seen that the incline of the upper section 12 may be readily adjusted by adding or removing one or more of the members 18, 20 to accommodate differences in the requirements or preferences of the sleeper.

The lower end 14 comprises one or more independent wedge shaped members 40, 42, 44 having a thick end 46 corresponding to the foot end of the bed 10 and a thin end 48 juxtaposed to the upper bed end 12. The members 40, 42, 44 are preferably unconnected to each other and depend on the cover 16 to retain them in position. It will accordingly be seen that the incline of the lower section 14 may be readily adjusted by adding or removing one or more of the members 40, 42, 44 to accommodate differences in the requirements or preferences of the sleeper.

The upper and lower ends 12, 14 may be made an inflatable structure providing a series of more-or-less independent air chambers which are inflated to provide the desired shape. Preferably, however, the upper and lower ends 12, 14 are made of any suitable foam material. To make the sleeping surfaces 34, 50 more comfortable, a foam sheet 52 having an egg crate surface may be placed on the upper and lower ends 12, 14 as suggested in FIGS. 6 and 7. The sheet 52 may be loose or may preferably be adhesively attached to the uppermost wedge shaped member 40 of the lower end 14. Attaching the sheet 52 to the lower end 14 provides additional stability in addition to that provided by the sheet or cover 16.

The cover 16 may be of any suitable type, such as a sheet or other fabric of suitable strength. Preferably, the cover 16 is a fitted sheet having ends 54, 56 of a predetermined distance apart thereby establishing the length of the bed 10. It will accordingly be apparent that the sheet 16 may be made in several lengths thereby controlling and adjusting the length of the bed 10. Because the upper and lower ends 12, 14 are of a constant width, the sheet 16 is typically made of the same constant width.

Use and adjustment of the bed 10 should now be apparent. The number of members 18, 20 to be used depend on the desired inclination of the upper section 12 and one or more members 18, 20 may be used or placed aside to achieve the desired end. Similarly, the number of members 40, 42, 44 to be used depends on the desired inclination of the lower section 14 and one or more of these members may be used or placed aside to achieve the desired result. If one wishes the make the sleeping surfaces 34, 50 more comfortable, a loose foam sheet 52 of egg crate design may be draped over the top of the upper and lower sections 12, 14. The cover or sheet 16 is placed around the sections 12, 14 thereby captivating the wedge shaped members and preventing them from moving. If one wishes to make the bed 10 shorter than the combined lengths of the upper and lower sections 12, 14, the thin ends of the members 18, 20, 40, 42, 44 may be interdigitated thereby shortening the overall length as in FIG. 9. In the situation where the bed 10 is used and sized for a child, it may be placed in a crib or toddler's bed to provide the sleeping surface.

It will be apparent that the upper section 12 is longer than the lower section 14 and the members 18, 20 are longer than the members 40, 42, 44. The purpose is to position the low spot of the V-shaped bed adjacent the knees of the sleeper. As shown in FIG. 8, a child may comfortably lie in a fetal position with the knees in the low spot of the V-shaped bed 10. The child is allowed considerable freedom of movement and the child's feet or lower legs push on the lower section 14 thereby preventing the child from slipping downward into the low spot of the bed 10.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A bed comprising a plurality of unconnected torso supporting wedges and a plurality of unconnected leg supporting wedges;

the torso supporting wedges including a first wedge shaped member for receiving a torso of a sleeper and having a thick end corresponding to a head end of the bed and a thin end, and a pair of side restraints extending along a side of the first member for restraining lateral movement of the sleeper off the first member, the side restraints each include a raised section adjacent an edge of the first wedge shaped member and an inclined side facing a centerline of the first wedge shaped member providing a generally concave sleeping surface;

the leg supporting wedges including at least one second wedge shaped member for receiving legs of the sleeper and having a thick end corresponding to a foot end of the bed and a thin end abutting the thin end of the first member, the first and second members being unconnected; and a cover covering the first and second members and constraining the members against movement away from each other.

2. The bed of claim 1 wherein the leg supporting wedges comprise a third wedge shaped member unconnected to the first and second wedge shaped members and lying under the second wedge shaped member, the third member having a thick end underlying the thick end of the second member and a thin end underlying the thin end of the second member.

3. The bed of claim 2 wherein the torso supporting wedges comprise a fourth wedge shaped member unconnected to the first and second wedge shaped members and lying under the first wedge shaped member, the fourth member having a thick end underlying the thick end of the first member and a thin end underlying the thin end of the first member.

4. The bed of claim 1 wherein the torso supporting wedges comprise a third wedge shaped member unconnected to the first and second wedge shaped members and lying under the first wedge shaped member, the third member having a thick end underlying the thick end of the first member and a thin end underlying the thin end of the first member.

5. The bed of claim 1 wherein the raised section of each side restraint includes a vertical side aligned with an edge of the first wedge shaped member.

6. The bed of claim 1 wherein the cover is a fitted sheet.

7. The bed of claim 1 wherein the wedge shaped members are foam.

8. The bed of claim 1 wherein the wedge shaped members are inflatable.

9. The bed of claim 1 further comprising a foam sheet overlying and unconnected to the first wedge shaped member and adhesively attached to an uppermost second wedge shaped member.

10. The bed of claim 1 wherein the first and second wedge shaped members provide a generally V-shaped bed having a low spot, the bed being sized so the low spot lies adjacent knees of a sleeper.

11. The bed of claim 1 wherein the bed is sized for a child.

12. A method of sleeping comprising providing a bed including a plurality of unconnected torso supporting wedges and a plurality of unconnected leg supporting wedges; the torso supporting wedges including a first wedge shaped member for receiving a torso of a sleeper and having a thick end corresponding to a head end of the bed and a thin end, and a pair of side restraints extending along a side of the first member for restraining lateral movement of the sleeper off the first member, the side restraints each include a raised section adjacent an edge of the first wedge shaped member and an inclined side facing a centerline of the first wedge shaped member providing a generally concave sleeping surface; the leg supporting wedges including at least one second wedge shaped member for receiving legs of the sleeper and having a thick end corresponding to a foot end of the bed and a thin end abutting the thin end of the first member, the first and second members being unconnected; and a cover covering the first and second members and constraining the members against movement away from each other, the first and second wedge shaped members providing a V-shaped sleeping surface having a low spot, the method comprising positioning a sleeper, on a side, on the sleeping surface with knees of the sleeper adjacent the low spot and lower legs of the sleeper pushing against the second wedge shaped member.

13. The method of sleeping comprising providing a bed including a plurality of unconnected torso supporting wedges and a plurality of unconnected leg supporting wedges; the torso supporting wedges including an upper end for receiving a torso of a sleeper, the upper end being inclined from an elevated position corresponding to a head end of the bed to a lower position adjacent an intermediate location on the bed and having a pair of side restraints extending along a side of an uppermost of the torso supporting wedges for restraining lateral movement of the sleeper off the upper end, the side restraints each including a raised section adjacent an edge of the first wedge shaped member and an inclined side facing a centerline of the first wedge shaped member providing a generally concave sleeping surface; the leg supporting wedges including a lower end inclined from an elevated position corresponding to a foot end of the bed to a lower position adjacent the upper end, the upper and lower ends providing a V-shaped sleeping surface having a low spot and a cover covering the first and second members and constraining the members against movement away from each other, the method comprising positioning a sleeper, on a side, on the sleeping surface with knees of the sleeper adjacent the low spot and lower legs of the sleeper pushing against an uppermost of the leg supporting wedges.

14. A bed comprising at least one torso supporting wedge and at least one leg supporting wedge, there being an unconnected plurality of at least one of the wedges;

the torso supporting wedge including at least one first wedge shaped member for receiving a torso of a sleeper and having a thick end corresponding to a head end of the bed and a thin end, and a pair of side restraints extending along a side of the first member for restraining lateral movement of the sleeper off the first member;

the leg supporting wedge including at least one second wedge shaped member for receiving legs of the sleeper and having a thick end corresponding to a foot end of the bed and a thin end, the first and second members being unconnected, the thin ends of the wedge members being interdigitated thereby shortening the overall length of the bed to less than the combined lengths of the wedge members; and a cover covering the torso and leg supporting wedges and constraining the wedges against movement away from each other thereby establishing the length of the bed.

* * * * *